US012385353B2

(12) United States Patent
Patel et al.

(10) Patent No.: US 12,385,353 B2
(45) Date of Patent: Aug. 12, 2025

(54) INTELLIGENT FLOW CONTROL VALVE REVERSE CHOKE POSITION

(71) Applicant: Schlumberger Technology Corporation, Sugar Land, TX (US)

(72) Inventors: Dinesh Patel, Humble, TX (US); Rashid Musayev, Rosharon, TX (US); Brad Swenson, Friendswood, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 18 days.

(21) Appl. No.: 17/755,632

(22) PCT Filed: Nov. 5, 2020

(86) PCT No.: PCT/US2020/059073
§ 371 (c)(1),
(2) Date: May 4, 2022

(87) PCT Pub. No.: WO2021/092147
PCT Pub. Date: May 14, 2021

(65) Prior Publication Data

US 2022/0356779 A1 Nov. 10, 2022

Related U.S. Application Data

(60) Provisional application No. 62/930,979, filed on Nov. 5, 2019.

(51) Int. Cl.
*E21B 34/02* (2006.01)

(52) U.S. Cl.
CPC ..... *E21B 34/025* (2020.05)

(58) Field of Classification Search
CPC ..... E21B 34/025; E21B 34/04; E21B 23/004; E21B 23/006; E21B 2200/02
See application file for complete search history.

(56) References Cited

U.S. PATENT DOCUMENTS 6,276,458 B1 8/2001 Malone et al.
6,668,935 B1 12/2003 McLoughlin et al.
(Continued)

FOREIGN PATENT DOCUMENTS

WO 0121935 A1 3/2001
WO 2006090168 A1 8/2006

OTHER PUBLICATIONS

International Search Report and Written Opinion issued in PCT/US2020/059073, dated Feb. 24, 2021 (12 pages).

*Primary Examiner* — Caroline N Butcher
(74) *Attorney, Agent, or Firm* — Jeffrey D. Frantz

(57) ABSTRACT

A mechanical indexer for an intelligent flow control valve comprising a plurality of choke positions is provided. The indexer can cycle from a full closed position, to a full open position, to gradually decreasing choke sizes. The indexer can cycle from a full closed position, to a full open position, to gradually decreasing choke sizes alternating with the full open position. The indexer can cycle from a full closed position, to a full open position, to a full closed position, to a full open position, to gradually decreasing choke sizes alternating with a full open position. The indexer can cycle from a full closed position, to a full open position, to a full closed position, to a full open position, to gradually decreasing choke sizes.

19 Claims, 6 Drawing Sheets

(56) References Cited

U.S. PATENT DOCUMENTS

| | | | | |
|---|---|---|---|---|
| 6,782,952 | B2 * | 8/2004 | Garay | E21B 43/14 166/374 |
| 6,892,816 | B2 | 5/2005 | Pringle et al. | |
| 7,584,800 | B2 | 9/2009 | Heath et al. | |
| 7,594,542 | B2 | 9/2009 | Loretz et al. | |
| 7,870,908 | B2 | 1/2011 | Mandrou | |
| 8,186,444 | B2 | 5/2012 | Patel | |
| 9,822,608 | B2 | 11/2017 | Avant | |
| 2001/0015276 | A1 * | 8/2001 | Pringle | E21B 34/08 166/321 |
| 2004/0007356 | A1 * | 1/2004 | Myron | E21B 34/14 166/240 |
| 2007/0295514 | A1 | 12/2007 | Rohde et al. | |
| 2009/0159290 | A1 * | 6/2009 | Lauderdale | E21B 23/006 166/319 |

* cited by examiner

INTELLIGENT FLOW CONTROL VALVE REVERSE CHOKE POSITION

CROSS-REFERENCE TO RELATED APPLICATIONS

Any and all applications for which a foreign or domestic priority claim is identified in the Application Data Sheet as filed with the present application are hereby incorporated by reference under 37 CFR 1.57. The present application is a national stage entry of International Application No. PCT/US2020/059073, filed Nov. 5, 2020, which claims priority benefit of U.S. Provisional Application No. 62/930,979, filed Nov. 5, 2019, the entirety of which are incorporated by reference herein and should be considered part of this specification.

BACKGROUND

Field

The present disclosure generally relates to systems and methods for flow control valves, such as intelligent flow control valves used in oil and gas wells, and more specifically to indexers and indexing methods for flow control valves.

Description of the Related Art

Valves are employed in a variety of applications to control flow of a fluid. Depending on the valve configuration, the valve may be actuated between two or more positions that correspond with two or more flow configurations. Generally, the valve is coupled with an actuation system, e.g. an electronic, hydraulic, or mechanical actuation system, which may be selectively operated to shift the valve between the flow configurations. The valve is shifted between positions by, for example, moving a valve element contained within the valve.

SUMMARY

An indexer for an intelligent flow control valve can cycle from closed to open to gradually decreasing choke sizes.

In some configurations, a mechanical indexer for an intelligent flow control valve comprising a plurality of choke positions is provided. The indexer can cycle from a full closed position, to a full open position, to gradually decreasing choke sizes. The indexer can cycle from a full closed position, to a full open position, to gradually decreasing choke sizes alternating with the full open position. The indexer can cycle from a full closed position, to a full open position, to a full closed position, to a full open position, to gradually decreasing choke sizes alternating with a full open position. The indexer can cycle from a full closed position, to a full open position, to a full closed position, to a full open position, to gradually decreasing choke sizes.

In some configurations, the mechanical indexer includes a first indexer member comprising a plurality of interconnected slots forming a track; and a second indexer member comprising a detent disposed within the track, wherein the second indexer member is configured to move relative to the first indexer member such that the detent travels along the track, and wherein a position of the detent relative to the track determines the choke position. The first indexer member can include or be formed as a sleeve, with the track formed in an outer surface of the sleeve. The second indexer member can include or be formed as a hollow ring having a bore therethrough, with the detent protruding into the bore from an inner surface of the ring. A flow control valve can include the mechanical indexer.

In some configurations, a choke system for use in a well includes: a valve comprising an orifice through which well fluid flow can be choked; an actuator configured to position the valve at one or more positions including a full open position, a full closed position, and a plurality of incremental positions having varying choke sizes between the full open position and the full closed position; and an indexing mechanism coupled to the actuator, the indexing mechanism configured to shift movement of the actuator to move the valve through the one or more positions from the full closed position, to the full open position, and through the plurality of incremental positions in an order corresponding to gradually decreasing choke sizes.

The indexing mechanism can include a first indexer member comprising a plurality of interconnected slots forming a track; and a second indexer member comprising a detent disposed within the track, wherein the second indexer member is configured to move relative to the first indexer member such that the detent travels along the track, and wherein a position of the detent relative to the track determines the choke position. The first indexer member can include or be formed as a sleeve, with the track formed in an outer surface of the sleeve. The second indexer member can include or be formed as a hollow ring having a bore therethrough, with the detent protruding into the bore from an inner surface of the ring. A flow control valve can include the mechanical indexer.

The indexing mechanism can be configured to shift the actuator to move the valve to the full open position between each of the incremental positions. The indexing mechanism can be configured to shift the actuator to move the valve from the full closed position, to the full open position, to the full closed position, to the full open position, and then through the plurality of incremental positions in an order corresponding to gradually decreasing choke sizes. The indexing mechanism can be configured to shift the actuator to move the valve to the full open position between each of the incremental positions.

In some configurations, a method of controlling flow of well fluid through a valve including an indexer includes: starting the indexer in a position corresponding to a full close position of the valve; transitioning the indexer to a position corresponding to a full open position of the valve; and cycling the indexer from the full open position through a series of incremental positions corresponding to decreasing choke sizes of the valve.

The indexer can include a first indexer member comprising a plurality of interconnected slots forming a track; and a second indexer member comprising a detent disposed within the track, wherein the second indexer member is configured to move relative to the first indexer member such that the detent travels along the track, and wherein a position of the detent relative to the track determines the choke position. Cycling the indexer through the series of incremental positions can include moving the second indexer member relative to the first indexer member such that the detent moves along the track. Cycling the indexer through the series of incremental positions can include moving the indexer to the position corresponding to the full open position of the valve between each of the series of incremental positions.

BRIEF DESCRIPTION OF THE FIGURES

Certain embodiments, features, aspects, and advantages of the disclosure will hereafter be described with reference to the accompanying drawings, wherein like reference numerals denote like elements. It should be understood that the accompanying figures illustrate the various implementations described herein and are not meant to limit the scope of various technologies described herein.

DETAILED DESCRIPTION

Figure 1C:
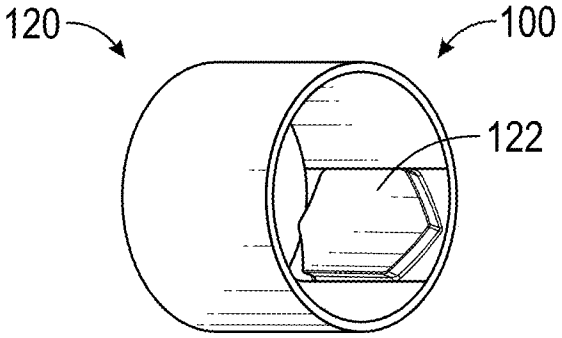
FIGS. 1A-1C show components of an example mechanical indexer design for an intelligent flow control valve.
Figure 1D:
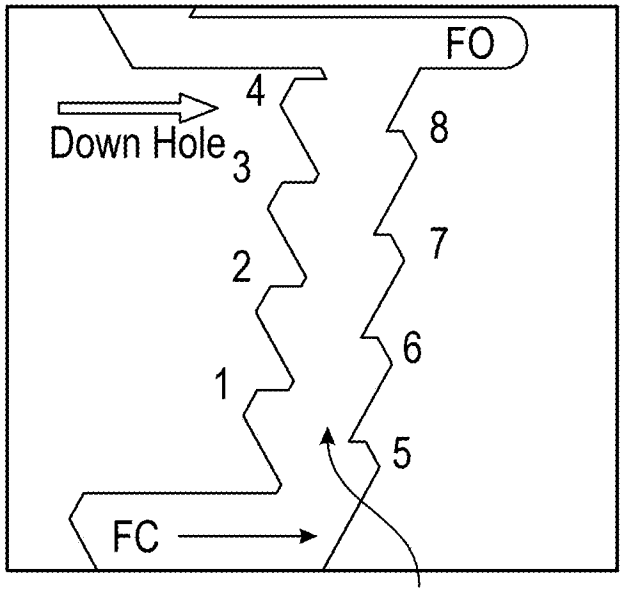
FIG. 1D shows an example indexer pattern of the mechanical indexer of FIGS. 1A-1C.

In the following description, numerous details are set forth to provide an understanding of some embodiments of the present disclosure. It is to be understood that the following disclosure provides many different embodiments, or examples, for implementing different features of various embodiments. Specific examples of components and arrangements are described below to simplify the disclosure. These are, of course, merely examples and are not intended to be limiting. However, it will be understood by those of ordinary skill in the art that the system and/or methodology may be practiced without these details and that numerous variations or modifications from the described embodiments are possible. This description is not to be taken in a limiting sense, but rather made merely for the purpose of describing general principles of the implementations. The scope of the described implementations should be ascertained with reference to the issued claims.

As used herein, the terms "connect", "connection", "connected", "in connection with", and "connecting" are used to mean "in direct connection with" or "in connection with via one or more elements"; and the term "set" is used to mean "one element" or "more than one element". Further, the terms "couple", "coupling", "coupled", "coupled together", and "coupled with" are used to mean "directly coupled together" or "coupled together via one or more elements". As used herein, the terms "up" and "down"; "upper" and "lower"; "top" and "bottom"; and other like terms indicating relative positions to a given point or element are utilized to more clearly describe some elements. Commonly, these terms relate to a reference point at the surface from which drilling operations are initiated as being the top point and the total depth being the lowest point, wherein the well (e.g., wellbore, borehole) is vertical, horizontal or slanted relative to the surface.

The present disclosure generally relates to systems and methods for controlling valve position and fluid flow. Such systems and methods can be used in oil and gas wells. A valve, such as a flow control valve, can be actuated among a plurality of fluid flow positions via an indexer. In some configurations, the present disclosure provides a choke system or valve adapted to choke the flow through one or more orifices of the valve. A valve actuator operably attached to the valve is able to position the valve at one or more incremental positions between an open position and a closed position. The valve actuator can define a predefined shifting sequence to provide the incremental positions of the valve. The change in flow area as the valve is actuated through the incremental positions varies so that predetermined changes in flow condition can be provided. As used here, flow condition may refer to pressure drop across the valve and/or flow rate through an orifice in the valve.

An indexing mechanism is connected to the actuator and/or choke to restrict motion of the valve actuator to provide the incremental positions between the open and closed choke positions. The indexing mechanism can be a mechanical indexer, such as a J-slot indexer. In some configurations, the indexing mechanism includes a first indexer member defining a plurality of elongated, spaced, interconnected slots and a second indexer member having an indexer detent pin. The indexer detent is adapted to mate with and move within the plurality of slots. The first and second indexer members are adapted for movement relative to one another, with the plurality of slots and the indexer detent adapted to cooperatively restrict the relative movement of the first and second indexer members.

Figure 6:
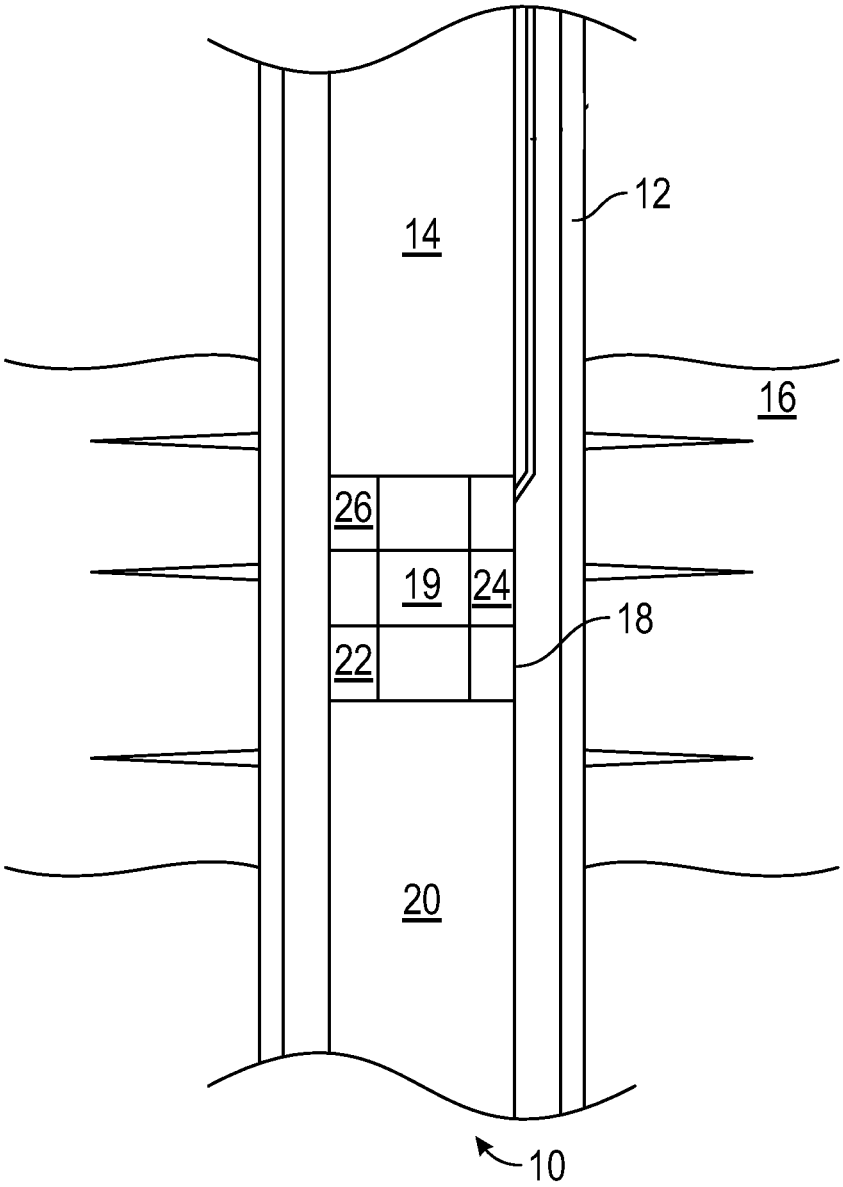
FIG. 6 schematically shows example downhole equipment including a choke system.

FIG. 6 illustrates a portion of example downhole equipment. As shown, a tubing section 14 extends inside a wellbore to a zone 16 (which may be a production zone or an injection zone, for example) in a formation. The wellbore 10 is lined with casing 12, which is perforated to allow fluids to flow from, or be injected into, the zone 16. A choke system or valve assembly 18 according to one embodiment is attached to the lower end of the tubing section 14. The choke system 18 at its lower end may also be attached to another tubing section 20. Fluid to be produced from, or injected into, the zone 16 passes through the bore 19 of the choke system and a bore (not shown) in the tubing section 14. The choke system 18 includes a valve 22 that may be incrementally set at and between open and closed positions to control fluid flow between a bore 19 of the choke system and the outside of the valve 22. Between the open and closed positions, the valve 22 may be set at one or more intermediate, incremental positions by a valve actuator 26 and indexing mechanism 24.

The indexer and/or choke positions of typical Intelligent Flow Control Valves (FCV) available in the market are configured to transition from a full closed (FC) position to gradually opening or incrementally increasing positions to a full open (FO) position. Generally, the FCV is placed in the full open position at the beginning of production or injection. However, the FCV is first placed in the closed position and then gradually opened to incrementally larger choke sizes to reach the full open position. Therefore, the production or injection must be shut in first, and then production or injection is started. This may have an adverse effect on the reservoir. Additionally, the FCV could fail to cycle during changing of the choke position. To go to, for example, choke position four, the FCV must first cycle through choke positions 1, 2, and 3. The production or injection will be severely choked if the FCV fails at, for example, position 1.

The present disclosure provides various indexer designs, e.g., mechanical indexer designs, for FCV. In some configurations, the indexer has reverse choke positions or a reverse indexer and/or choke pattern or sequence. In other words, in some configurations, the indexer cycles from closed to full open to gradually smaller choke sizes, rather than closed to gradually larger choke sizes as in previously available valves. Designs according to the present disclosure can advantageously help prevent or reduce the likelihood of adverse effects due to FCV failure.

Figure 1A:
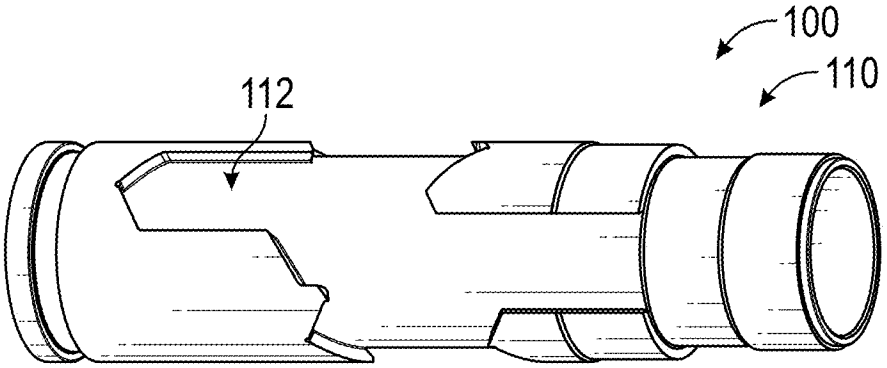
Figure 1B:
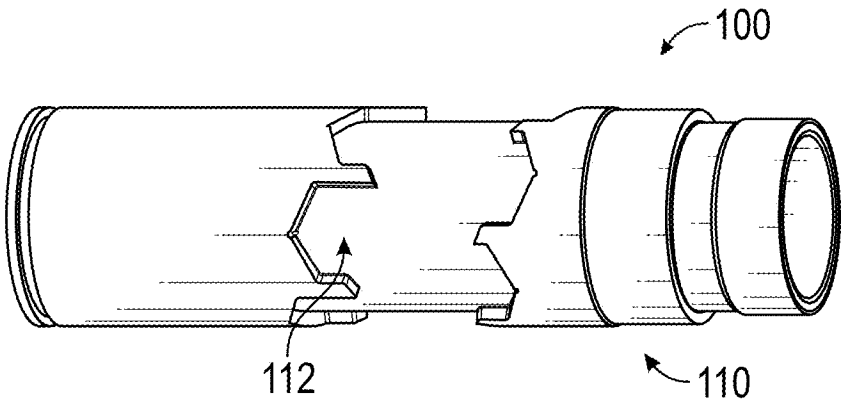

Referring to FIGS. 1A-1C, in some configurations, an indexer 100 includes a first indexer member 110 defining or including a plurality of elongated, spaced, interconnected slots 112 and a second indexer member 120 having an indexer detent 122. As shown, the first indexer member 110 can include or be formed as a first sleeve or tube, with the slots 112 formed in or on an outer or external surface. The second indexer member 120 can include or be formed as a second hollow sleeve or ring having a bore therethrough, with the detent protruding into the bore from an inner or internal surface of the ring. In use, the second indexer member 120 is disposed about the first indexer member 110 such that the detent 122 is disposed in the slots 112. The second indexer member 120 is configured to rotate about and move along the first indexer member 110 such that the detent 122 moves along and relative to the slots 112 to change the indexer position, and therefore the choke position of the valve. FIG. 10 shows an example indexer slot 112 track configuration or pattern. Various other indexer 100 configurations are possible.

The choke or valve includes one or more orifices. For example, the valve can include a plurality of orifices, each corresponding to one of the positions of the indexer 100, or an orifice having a series of segments or increment areas, each segment or increment area corresponding to one of the positions of the indexer 100. The position of the detent 122 relative to the slots 112 determines the choke position. For example, when the detent 122 is positioned relative to the slots 112 such that the indexer 100 is in the full open (FO) position, all of the plurality of orifices, or the entirety of an orifice having multiple segments or increment areas, can be uncovered and/or open. When the detent 122 is positioned relative to the slots 112 such that the indexer 100 is in the full close (FC) position, all of the plurality of orifices, or the entirety of an orifice having multiple segments or increment areas, can be covered and/or closed. When the detent 122 is positioned relative to the slots 112 such that the indexer 100 is in an incremental position between FO and FC, a subset of the orifices, or a portion of the orifice, can be uncovered and/or open.

Figure 2B:
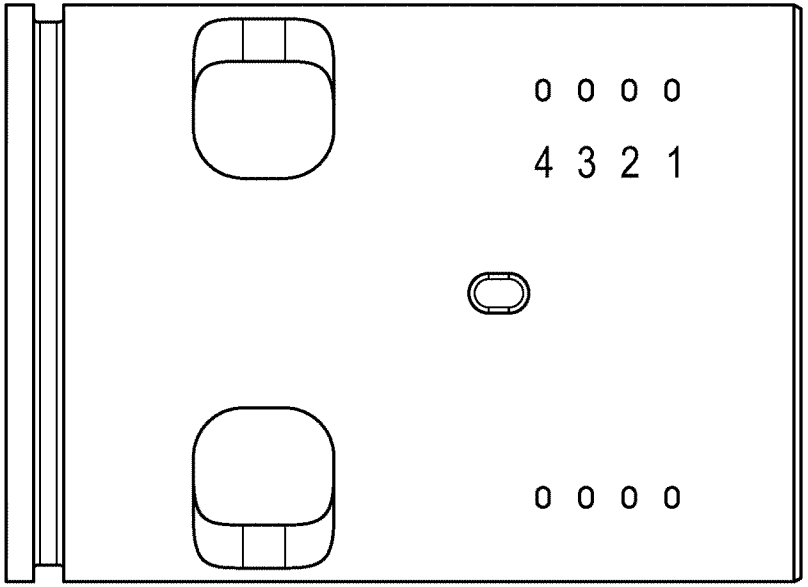
FIG. 2B shows various choke positions corresponding to the indexer pattern of FIG. 2A.
Figure 2A:
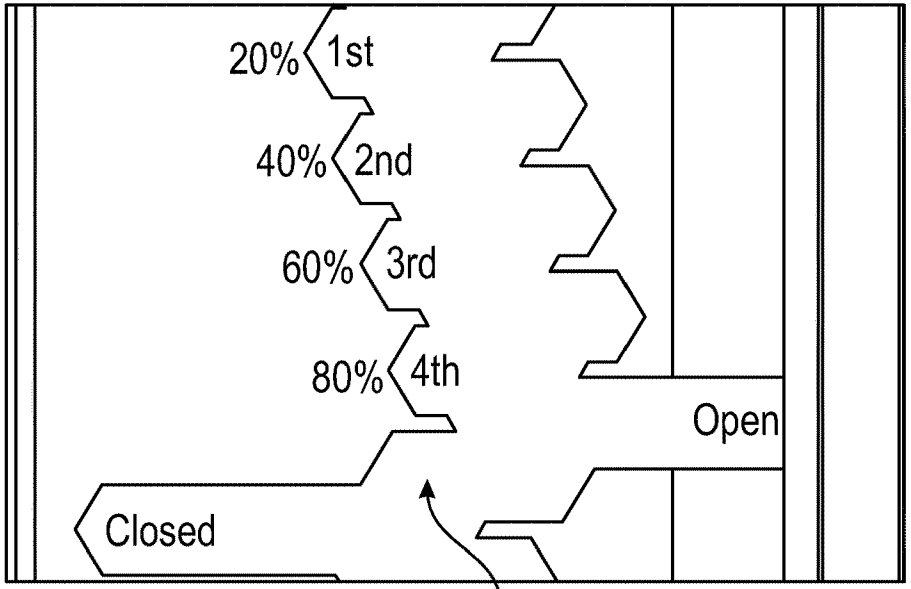
FIG. 2A shows a flattened view of an example mechanical indexer design for an intelligent flow control valve.
Figure 3B:
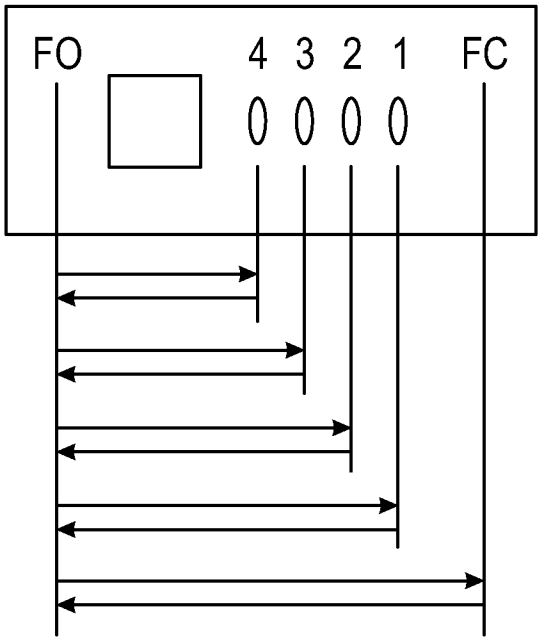
FIG. 3B shows choke positions corresponding to the indexer pattern of FIG. 3A.
Figure 3A:
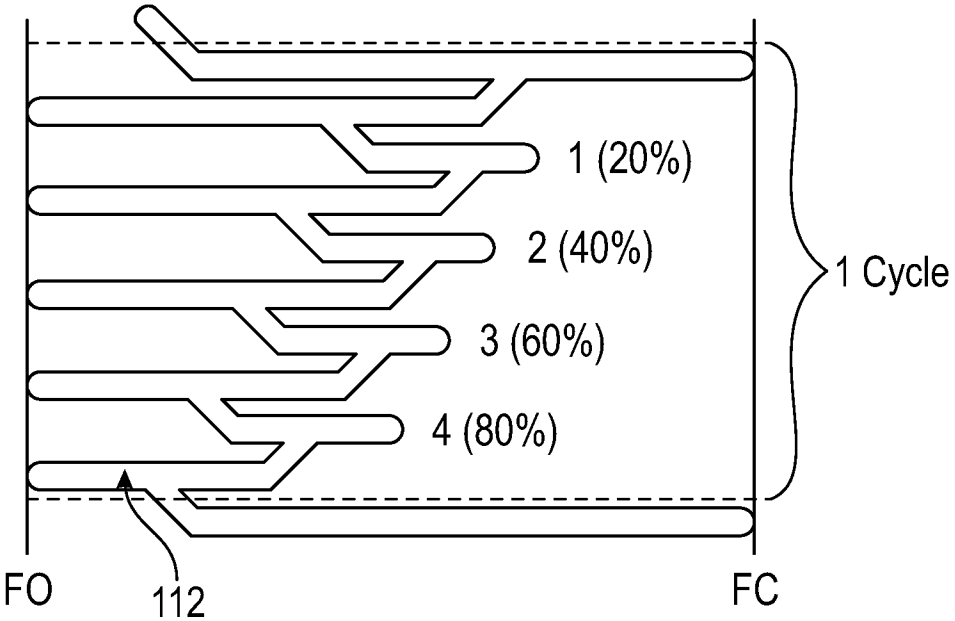
FIG. 3A shows a flattened view of an example indexer pattern for an intelligent flow control valve.
Figure 4B:
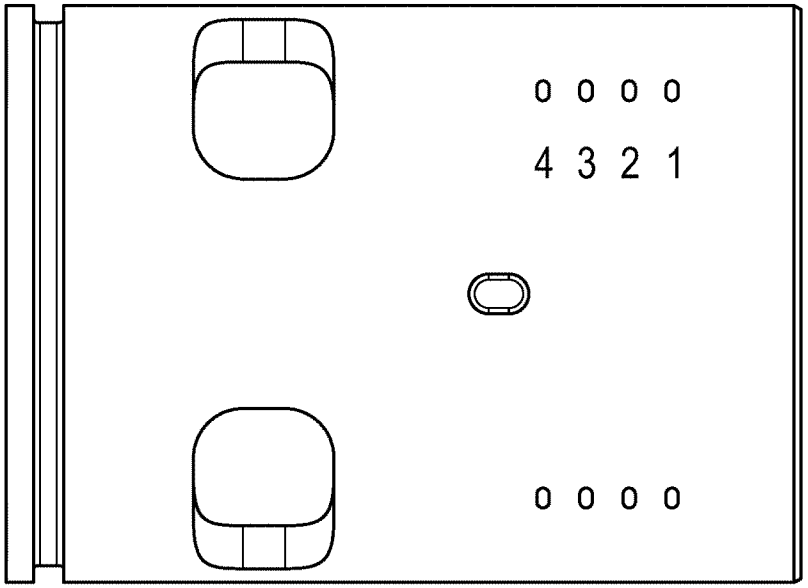
FIG. 4B shows various choke positions corresponding to the indexer pattern of FIG. 4A.
Figure 4A:
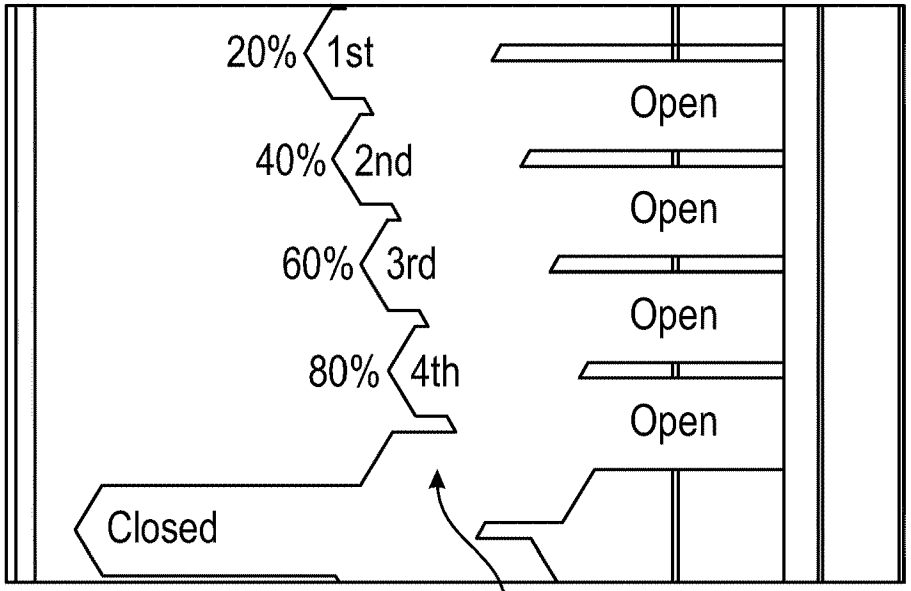
FIG. 4A shows an example mechanical indexer design for an intelligent flow control valve.

FIGS. 2A-2B illustrate a configuration having a reverse choke such that the FCV cycles from the full open position to gradually smaller choke positions to the closed position. Such a configuration can help alleviate the concern of the FCV failing in the smallest choke position when it is desired to have FCV in a larger choke position. In the illustrated configuration, the indexer 100 has and can cycle through a full close (FC) position, a full open (FO) position, and four incremental positions between FC and FO, as shown in FIG. 2A. In the example of FIGS. 2A-2B, incremental position 1 can correspond to 20% of the orifice(s) uncovered or open, position 2 can correspond to 40% of the orifice(s) uncovered or open, position 3 can correspond to 60% of the orifice(s) uncovered or open, and position 4 can correspond to 80% of the orifice(s) uncovered or open. In use, the indexer 100 can transition or cycle in the pattern FO-4-3-2-1-FC or FC-FO-4-3-2-1-FC. In other configurations, the valve and indexer 100 may have more or fewer incremental positions between FC and FO and/or each incremental position can correspond to a different percentage of the orifice(s) being uncovered or open.

FIGS. 3A-4B illustrate configurations in which the indexing positions and/or cycles are arranged such that the FCV always first goes in or to the full open position when changing from one choke position to another choke position. This arrangement ensures a full open position every alternate cycle. In the illustrated example, the indexer 100 can transition or cycle in the pattern FO-4-FO-3-FO-2-FO-1-FO-FC or FC-FO-4-FO-3-FO-2-FO-1-FO-FC. The valve and indexer 100 may have more or fewer incremental positions between FC and FO and/or each incremental position can correspond to a different percentage of the orifice(s) being uncovered or open.

Figure 5B:
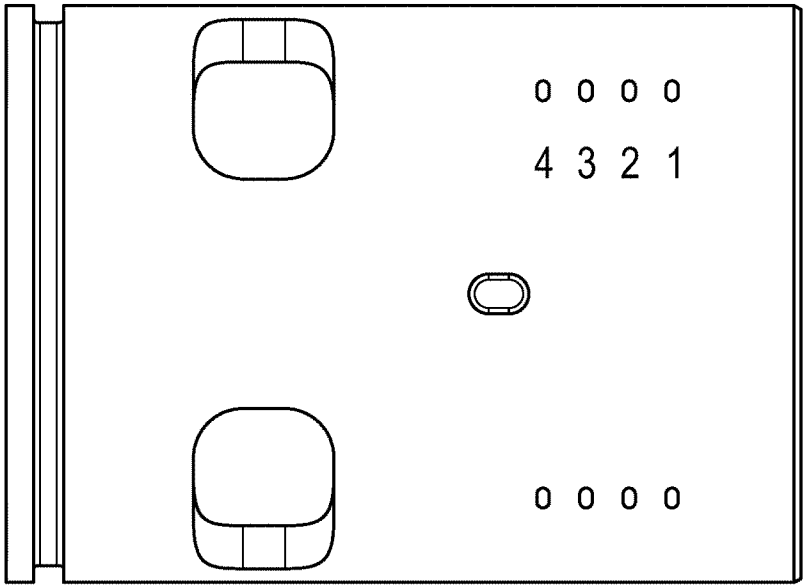
FIG. 5B shows various choke positions corresponding to the indexer pattern of FIG. 5A.
Figure 5A:
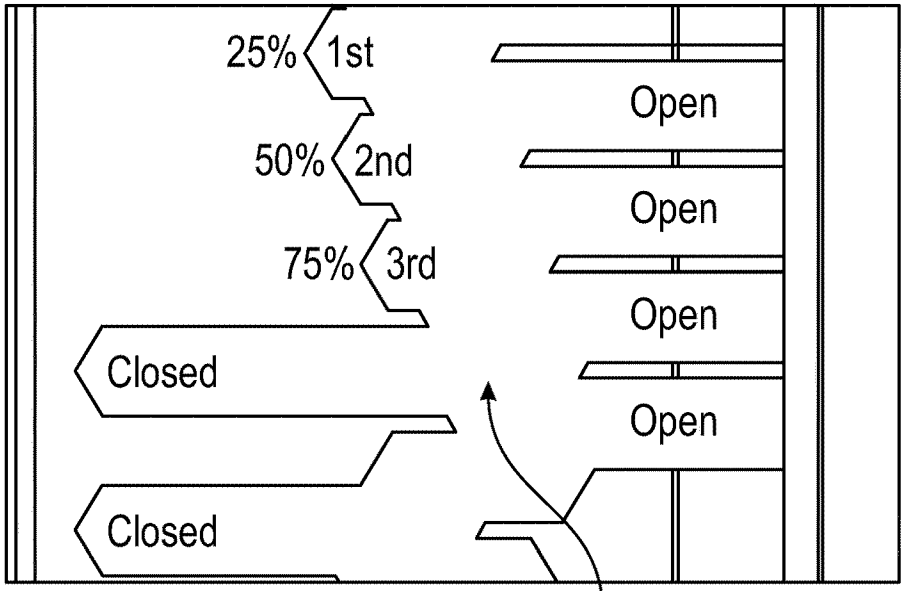
FIG. 5A shows an example mechanical indexer design for an intelligent flow control valve.

FIGS. 5A-5B illustrate a configuration in which the indexing positions and/or cycles are arranged to allow the FCV to go from full open to full closed and then full open before gradually cycling to smaller choke positions to close. This arrangement allows quick closure of the FCV from full open in the event of a well control issue. For example, the indexer 100 can transition or cycle in the pattern FO-FC-FO-4-3-2-1-FC; FO-FC-FO-4-FO-3-FO-2-FO-1-FC; or FO-FC-FO-4-FO-3-FO-2-FO-1-FO-FC. In the example illustrated in FIG. 5A, the indexer 100 has 3 incremental positions, which can correspond to 3 incremental positions of the choke. In the illustrated example, position 3 corresponds to 75% of the orifice(s) uncovered or open, position 2 corresponds to 50% of the orifice(s) uncovered or open, and position 1 corresponds to 25% of the orifice(s) uncovered or open. In such a configuration, the indexer 100 can transition or cycle in the pattern FO-FC-FO-3-2-1-FC; FO-FC-FO-3-FO-2-FO-1-FC; or FO-FC-FO-3-FO-2-FO-1-FO-FC.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately," "about," "generally," and "substantially" may refer to an amount that is within less than 10% of, within less than 5% of, within less than 1% of, within less than 0.1% of, and/or within less than 0.01% of the stated amount. As another example, in certain embodiments, the terms "generally parallel" and "substantially parallel" or "generally perpendicular" and "substantially perpendicular" refer to a value, amount, or characteristic that departs from exactly parallel or perpendicular, respectively, by less than or equal to 15 degrees, 10 degrees, 5 degrees, 3 degrees, 1 degree, or 0.1 degree.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims. It is also contemplated that various combinations or sub-combinations of the specific features and aspects of the embodiments described may be made and still fall within the scope of the disclosure. It should be understood that various features and aspects of the disclosed embodiments can be combined with, or substituted for, one another in order to form varying modes of the embodiments of the disclosure. Thus, it is intended that the scope of the disclosure herein should not be limited by the particular embodiments described above.

What is claimed is:

1. A mechanical indexer for an intelligent flow control valve comprising a plurality of choke positions, wherein the mechanical indexer is configured to cycle from a full closed position directly to a full open position, and the mechanical indexer is also configured to cycle through the plurality of choke positions in an order corresponding to gradually decreasing choke sizes.

2. The mechanical indexer of claim 1, wherein in use, the mechanical indexer cycles from the full closed position, to the full open position, to the gradually decreasing choke sizes alternating with the full open position.

3. The mechanical indexer of claim 1, wherein in use, the mechanical indexer cycles from the full closed position, to the full open position, to the full closed position, to the full open position, to the gradually decreasing choke sizes alternating with the full open position.

4. The mechanical indexer of claim 1, wherein in use, the mechanical indexer cycles from the full closed position, to the full open position, to the full closed position, to the full open position, to the gradually decreasing choke sizes.

5. The mechanical indexer of claim 1, comprising:

a first indexer member comprising a plurality of interconnected slots forming a track; and a second indexer member comprising a detent disposed within the track, wherein the second indexer member is configured to move relative to the first indexer member such that the detent travels along the track, and wherein a position of the detent relative to the track determines the choke position.

6. The mechanical indexer of claim 5, wherein the first indexer member comprises a sleeve, and the track is formed in an outer surface of the sleeve.

7. The mechanical indexer of claim 5, wherein the second indexer member comprises a hollow ring having a bore therethrough, and the detent protrudes into the bore from an inner surface of the hollow ring.

8. A flow control valve comprising the mechanical indexer of claim 1.

9. A choke system for use in a well, comprising:

a valve comprising an orifice through which well fluid flow can be choked;

an actuator configured to position the valve at one or more positions including a full open position, a full closed position, and a plurality of incremental positions having varying choke sizes between the full open position and the full closed position; and an indexing mechanism coupled to the actuator, the indexing mechanism configured to shift movement of the actuator to move the valve through the one or more positions from the full closed position directly to the full open position, and the indexing mechanism is configured to cycle through the plurality of incremental positions in an order corresponding to gradually decreasing choke sizes.

10. The choke system of claim 9, the indexing mechanism comprising:

a first indexer member comprising a plurality of interconnected slots forming a track; and a second indexer member comprising a detent disposed within the track, wherein the second indexer member is configured to move relative to the first indexer member such that the detent travels along the track, and wherein a position of the detent relative to the track determines the choke position.

11. The choke system of claim 10, wherein the first indexer member comprises a sleeve, and the track is formed in an outer surface of the sleeve.

12. The choke system of claim 10, wherein the second indexer member comprises a hollow ring having a bore therethrough, and the detent protrudes into the bore from an inner surface of the hollow ring.

13. The choke system of claim 9, wherein the indexing mechanism is configured to shift the actuator to move the valve to the full open position between each of the incremental positions.

14. The choke system of claim 9, wherein the indexing mechanism is configured to shift the actuator to move the valve from the full closed position, to the full open position, to the full closed position, to the full open position, and then through the plurality of incremental positions in an order corresponding to the gradually decreasing choke sizes.

15. The choke system of claim 14, wherein the indexing mechanism is configured to shift the actuator to move the valve to the full open position between each of the incremental positions.

16. A method of controlling flow of well fluid through a valve comprising an indexer, the method comprising:

starting the indexer in a position corresponding to a full close position of the valve;

directly transitioning the indexer to a position corresponding to a full open position of the valve; and cycling the indexer from the full open position through a series of incremental positions corresponding to decreasing choke sizes of the valve.

17. The method of claim 16, wherein the indexer comprises:

a first indexer member comprising a plurality of interconnected slots forming a track; and a second indexer member comprising a detent disposed within the track, wherein the second indexer member is configured to move relative to the first indexer member such that the detent travels along the track, and wherein a position of the detent relative to the track determines the choke position.

18. The method of claim 17, wherein cycling the indexer through the series of incremental positions comprises moving the second indexer member relative to the first indexer member such that the detent moves along the track.

19. The method of claim 16, wherein cycling the indexer through the series of incremental positions comprises moving the indexer to the position corresponding to the full open position of the valve between each of the series of incremental positions.

* * * * *